US007219591B2

(12) United States Patent
Loedige et al.

(10) Patent No.: US 7,219,591 B2
(45) Date of Patent: May 22, 2007

(54) HYDRAULIC CONTROL ARRANGEMENT

(75) Inventors: Heinrich Loedige, Vaihingen (DE); Christoph Keyl, Korntal-Muenchingen (DE)

(73) Assignee: Bosch Rexroth AG, Stuttgart (DE)

( * ) Notice: Subject to any disclaimer, the term of this patent is extended or adjusted under 35 U.S.C. 154(b) by 0 days.

(21) Appl. No.: 11/350,886

(22) Filed: Feb. 10, 2006

(65) Prior Publication Data

US 2006/0201321 A1 Sep. 14, 2006

(30) Foreign Application Priority Data

Mar. 11, 2005 (DE) ..... 10 2005 011 395

(51) Int. Cl.
*F15B 11/08* (2006.01)
*F15B 13/02* (2006.01)

(52) U.S. Cl. ..... 91/433; 91/446

(58) Field of Classification Search ..... 91/433, 91/446, 454; 137/596.2; 60/422
See application file for complete search history.

(56) References Cited

U.S. PATENT DOCUMENTS 6,220,027 B1 * 4/2001 Heusser ..... 60/422
6,499,505 B2 * 12/2002 Zenker et al. ..... 137/596.2
2006/0090460 A1 * 5/2006 Ma et al. ..... 60/459
2006/0162544 A1 7/2006 Loedige et al.

FOREIGN PATENT DOCUMENTS

| | | | |
|---|---|---|---|
| DE | 34 36 246 | A1 | 4/1986 |
| DE | 36 39 174 | C2 | 5/1988 |
| DE | 199 31 142 | C2 | 1/2001 |
| DE | 100 45 404 | C2 | 4/2002 |
| DE | 102 16 958 | B3 | 1/2004 |
| DE | 103 21 914 | A1 | 12/2004 |
| EP | 1 452 744 | A1 | 9/2004 |

* cited by examiner

*Primary Examiner*—Thomas E. Lazo
(74) *Attorney, Agent, or Firm*—Oliff & Berridge, PLC

(57) ABSTRACT

What is disclosed is a hydraulic control arrangement for controlling a hydraulic consumer, comprising an adjustable supply measuring orifice and an adjustable drain measuring orifice as well as a pressure compensator arranged in a pressure medium delivery. The control arrangement moreover comprises a releasable cut-off block that acts as a check valve in the direction of supply and may be released in the direction of drain by means of a control pressure. In accordance with the invention, the pressure compensator is subjected to a constant force in the opening direction and to the lower one of the pressures downstream from the supply measuring orifice and upstream from the drain measuring orifice in the closing direction.

10 Claims, 1 Drawing Sheet

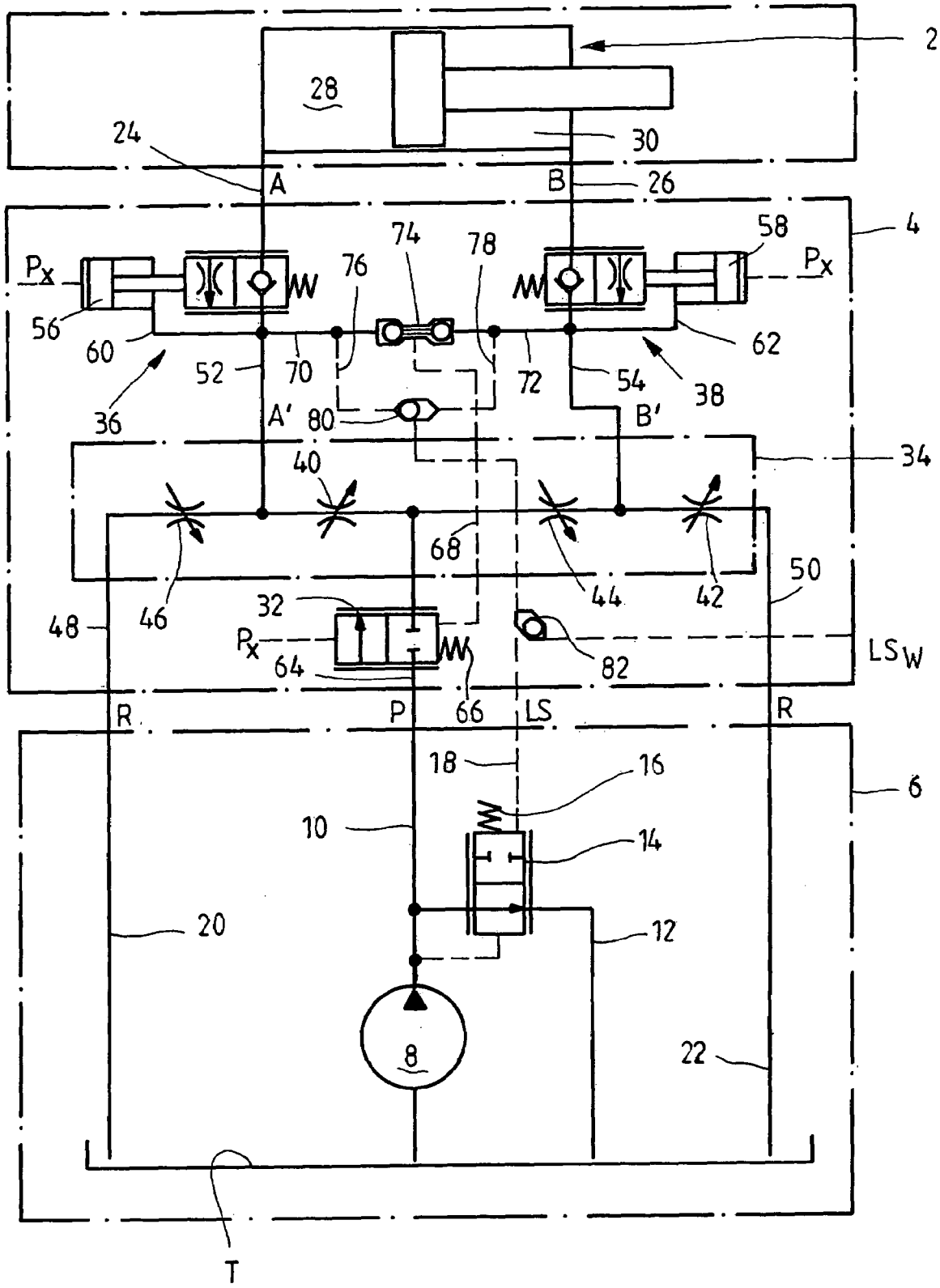
2
28
30
24
A
B
26
4
58
Px
Px
74
78
76
56
60
62
52
70
72
54
38
36
A'
80
B'
34
40
68
50
46
44
42
48
32
Px
64
66
82
LSW
R
P
LS
R
18
16
6
10
14
20
12
8
22
T

HYDRAULIC CONTROL ARRANGEMENT

The invention relates to a hydraulic control arrangement for controlling a consumer in accordance with the preamble of claim 1.

From DE 100 45 404 C2 a control arrangement is known, wherein a hydraulic consumer, for instance a double-acting cylinder for moving a load, may be supplied with pressure medium via a continuously adjustable directional control valve. In the pressure medium supply to the cylinder and in the drain from the cylinder, respective releasable cut-off valves are provided, wherein the supply-side cut-off valve is taken into an opened position by the pressure downstream from the directional control valve. By actuation of a topping piston, the drain-side cut-off valve may be taken into an opened position that allows the pressure medium to drain from the consumer towards the directional control valve. In this solution, a drain regulation is effected via the drain-side cut-off block by feeding back the drain pressure to the topping piston of the cut-off block in front of the spool control edge of the continually adjustable directional control valve determining the drain.

In DE 199 31 142 C2 a control arrangement is disclosed wherein a supply regulation takes place via an individual pressure compensator arranged upstream of the regulating valve. This individual pressure compensator is subjected to the force of a spring in the opening direction and to the pressure in the supply in the direction towards the consumer.

DE 36 39 174 C2 discloses a control arrangement for a single-acting hydraulic consumer, wherein a continually adjustable directional control valve is preceded by a LS (load-sensing) pressure compensator which is subjected to the force of a spring and to the individual load pressure in the closing direction, and to the pressure between the pressure compensator and the directional control valve in the opening direction. The known control arrangement further comprises a load-compensated, releasable cut-off valve whereby a drain regulation may be carried out.

In DE 102 16 958 a hydraulic control arrangement is shown wherein upstream from a supply measuring orifice a LS pressure compensator is provided with is subjected to the force of a spring and to the highest pressure downstream from the supply measuring orifice and upstream from a drain measuring orifice in the opening direction. In the closing direction, the pressure upstream from the supply measuring orifice acts on the LS pressure compensator.

All of the above described practical examples share the drawback that the control edges (supply control edge, drain control edge) determining the supply cross-section and the drain cross-section of the measuring orifices must be adapted to each other with extreme accuracy.

It is furthermore a drawback in these solutions that either only the pressure medium volume flow to the consumer or the volume flow draining from the consumer may be controlled in a load-independent manner. Moreover particularly in the control of double-acting cylinders in the event of so-called pulling loads—namely, of loads where the pressure in the drain is higher than in the supply—there is a risk of an insufficient supply of the supply-side cylinder chamber. Such an insufficiency may lead to cavitations causing damage to the consumer or to the hydraulic switching elements associated with the latter. Such an operating condition may occur, e.g., during downhill travel or whenever a load is initially raised, then overcomes a dead center, and subsequently exerts a pull on the hydraulic consumer.

In order to avoid such insufficient supply of the consumer, it is, e.g., possible to use anti-cavitation valves. Owing to the comparatively low differential pressure between the suction side and the tank pressure during replenishing, however, these valves need to have a very large cross-section.

One alternative possibility is to provide biasing valves in the pressure medium drain. Such biasing valves are, however, accompanied by a high energy loss, for the supply pressure, particularly with small loads, must be raised strongly.

Another option is to use brake valves. These do, however, equally require a comparatively high pressure on the supply side in order to control the volume flow on the drain side and thus avoid an insufficiency of the supply side.

In other words, these known options for avoiding an insufficient supply (anti-cavitation valve, biasing valve, countertorque lowering valve) require considerable complexity in terms of circuit technology and moreover incur energy losses.

In contrast, the invention is based on the object of furnishing a hydraulic control arrangement for controlling a consumer, whereby an insufficient supply may be avoided with low expense, and wherein the pressure medium volume flow to the consumer and the pressure medium volume flow draining from the consumer may be controlled in a load-independent manner.

This object is achieved through a hydraulic control arrangement having the features of claim 1.

The hydraulic control arrangement in accordance with the invention is executed with an adjustable supply measuring orifice and an adjustable drain measuring orifice, wherein a pressure compensator arranged in the pressure medium delivery is subjected in the opening direction to a constant force and in the closing direction to the lower one of the pressures downstream from the supply measuring orifice and upstream from the drain measuring orifice. In the pressure medium drain a releasable cut-off block is provided which acts as a check valve in the direction of supply and regulates the drain pressure medium volume flow in the pressure medium drain.

Owing to the interaction of the pressure compensator and of the load-compensated cut-off block, both the pressure medium volume flow towards the consumer and the pressure medium volume flow draining from the consumer may be maintained constant independently of the load pressure. Furthermore the consumer may be biased with the aid of the pressure compensator and the cut-off block in any operating conditions, so that the insufficiency in the pressure medium supply mentioned at the outset is safely avoided.

The bias of the consumer may be adapted to the system in a simple manner by adjusting the constant force acting on the pressure compensator in the opening direction.

The solution in accordance with the invention may be realized at low expense, with the above described additional valve arrangements, such as anti-cavitation valves, biasing valves, countertorque lowering valves etc., not being required. Due to the bias of the consumer, air discharges on the suction side may reliably be avoided.

It was furthermore found that in the hydraulic control arrangement in accordance with the invention, a reduced increase of the supply pressure is necessary, so that energy saving in comparison with conventional solutions is made possible.

In a particularly preferred embodiment of the invention, a flow rate of a pump of the hydraulic control arrangement is controlled depending on the higher one of the pressures downstream from the supply measuring orifice and upstream from the drain measuring orifice. This flow rate is regulated such that a pump pressure exceeding the load pressure by a particular pressure difference Δp is present in the pump line (LS system).

The supply and drain measuring orifices are preferably formed by a continuously adjustable directional control valve, the work ports of which are connected to a supply line and a drain line, the pressure port of which is connected with a delivery line, and the tank port of which is connected with a return line.

The solution in accordance with the invention allows to make the supply cross-section controlled open by a supply control edge larger than the drain cross-section controlled open by a drain control edge, or to control the drain cross-section open at a later time, so that due to the reduced demands to the supply control edge, the harmonization of the two control edges is simplified. The velocity of the consumer will then always be determined by the drain cross-section.

The constant force acting on the pressure compensator is in one variant of the invention applied through a control pressure acting on a control surface of a pressure compensator piston. As an alternative, the constant force may also be applied through a spring or the like to the pressure compensator piston.

The adaptation of the bias of the consumer may then be altered in a simple manner by adjusting the constant pressure. The latter may through suitable switching also be lowered to Zero, so that the pressure medium may flow off from the consumer without the pressure medium being supplied to the supply side.

In the control of a double-acting consumer, e.g., a differential cylinder, releasable cut-off blocks each having a topping piston adapted to be actuated by a control pressure are provided preferably both in the supply and in the drain. The structure of the control arrangement is particularly simple if this control pressure corresponds to the constant control pressure acting on the pressure compensator in the opening direction.

The lower pressure downstream from the supply measuring orifice and upstream from the drain measuring orifice may be tapped by means of an inverse shuttle valve.

Further advantageous developments of the invention are subject matter of further subclaims.

In the following a preferred practical example of the invention shall be explained by referring to a single FIGURE showing a circuit diagram of a hydraulic control arrangement for controlling a double-acting consumer.

The like control arrangements are used particularly for controlling the consumer of a mobile working tool, e.g., in a stacker or a tractor. In the represented practical example, the consumer has the form of a differential cylinder 2 adapted to be connected with a pressure medium supply 6 via a valve arrangement 4.

The pressure medium supply 6 comprises in the represented practical example a fixed displacement pump 8 whereby the pressure medium is sucked from a tank T and conveyed in a pump line 10. From the pump line 10 a bypass line 12 branches off having arranged therein an inlet pressure compensator 14 which is subjected to the pressure in the pump line 10 in the opening direction and to the highest load pressure of all the consumers as well as the force of a spring 16 in the closing direction. This highest load pressure is in a known manner tapped via a shuttle valve cascade from all the consumers of the system and is present at the inlet pressure compensator 14 via a load reporting line 18. The pump 8 may have the form of a fixed displacement pump with a speed-regulated drive mechanism, or a variable displacement pump.

The pressure medium flowing back from the cylinder 2 returns to the tank T—depending on the direction of movement of the cylinder 2—via a return line 20 or a return line 22.

The valve arrangement having, e.g., the form of a valve disk of a mobile control block, includes a pressure port P, a LS port LS, two return ports R, as well as two work ports A, B, wherein the latter are connected via work lines 24, 26 with a bottom-side cylinder chamber 28 or a piston rod-side annular chamber 30, respectively.

As may furthermore be seen from the FIGURE, the two return lines 20, 22 are connected with the two return ports R, the pump line 10 with the pump port P, and the load reporting line 18 with the LS port LS. The valve arrangement essentially consists of a pressure compensator, hereinafter referred to as the individual pressure compensator 32, a continually adjustable directional control valve 34 indicated by dash-dotted lines, as well as two releasable cut-off blocks 36, 38. The continuously adjustable directional control valve 34 customarily has a directional control element determining the direction of pressure medium flow and a velocity element respectively formed by a supply measuring orifice and a drain measuring orifice. In the represented circuit diagram, four measuring orifices are represented schematically, with only two measuring orifices being effective, however, depending on the adjustment of the directional control element. I.e., in the case of a pressure medium flow to the work port A, the measuring orifice designated by reference number 40 acts as a meter-in orifice, whereas the drain measuring orifice is designated by reference number 42 and is active in the case of a pressure medium flow from the work port B to the tank T. Upon reversing the direction of flow, the measuring orifices represented in addition then become active as a supply measuring orifice 44 and as a drain measuring orifice 46. The two drain measuring orifices 42, 46 are arranged in a return passage 48 or 50 connected with a respective one of the return ports R.

The directional control valve includes two work ports A' and B' that are connected via a supply line 52 and a drain line 54 with the work ports A, B. The construction of the cut-off blocks 36, 38 is known per se, so that detailed explanations are not necessary. With the aid of a topping piston 56 or 58, respectively, these cut-off blocks 36, 38 may be taken from a spring-biased basic position, in which they each act as a check valve, into a through position allowing a return flow of the pressure medium from the cylinder 2. Actuation of the topping piston 56, 58 is effected through a constant control pressure $p_x$ tapped from a suitable control pressure supply. In the opposite direction, the pressure (viewed in the direction of drain) downstream from the respective cut-off block 36, 38, which is tapped via a passage 60 or 62 from the supply passage 52 or from the drain passage 54, respectively, acts on an annular surface of the topping piston 58. By thus feeding back the load pressure into the drain, the cut-off block 36, 38 operates in a load-compensated manner and regulates the pressure in the respective associated line, which then acts as a drain passage, to a constant value in a load-independent manner. The respective cut-off block located in the supply then operates as a check valve.

Inside a delivery passage 64 connected to the pressure port P of the valve arrangement 4, the individual pressure compensator 32 is arranged which is subjected to the constant control pressure $p_x$ in the opening direction and to the force of a pressure compensator spring 66 and to a pressure in a reporting passage 68 in the closing direction. This pressure is the smaller one of the pressures in the supply passage 52 and in the drain passage 54, i.e., the smaller one of the pressures downstream from the supply measuring orifice 40 and upstream from the drain measuring orifice 42 (for a pressure medium flow towards the work port A and from the work port B to the tank T). This pressure is tapped by the supply passage 52 and by the drain passage 54 via a respective tapping passage 70, 72 that each lead to an inlet of an inverse shuttle valve 74. The output thereof is connected to the reporting passage 68.

From the tapping passages 70, 72 respective LS branch passages 76, 78 branch off which are each connected to an inlet of a shuttle valve 80, the outlet of which is connected with the inlet of another LS shuttle valve 82 of the above mentioned LS shuttle valve cascade, through which the highest load pressure of all the consumers supplied by the pump 8 is tapped. This highest load pressure is then present in the load reporting line 18 and acts on the spool of the inlet pressure compensator 14 in the closing direction.

For an improved understanding of the invention, the operation of the control arrangement in accordance with the invention shall now be explained by way of an extension of the cylinder 2, i.e., the pressure medium is conveyed by the pump 8 via the work port A into the cylinder chamber 28 and again displaced from the annular chamber 30 via the work port B towards the tank T. Here the measuring orifice 40 acts as a supply measuring orifice, and the measuring orifice 42 as a drain measuring orifice; the measuring orifices 44, 46 are closed.

Basic Operation

In order to extend the cylinder 2, the directional control valve 34 is adjusted such that a supply control edge of the directional control valve 34 opens the cross-section of the supply measuring orifice 40 and accordingly a drain control edge of the cross-section of the drain measuring orifice 42 opens. The directional control valve 34 is designed such that the opening cross-section of the supply measuring orifice 40 is larger than that of the drain measuring orifice. The pressure medium then flows via the pressure compensator 32, the operation of which shall be explained in more detail in the following, the opened supply measuring orifice 40, the supply passage 52, and the cut-off block 36 acting as a check valve, via the work port A and the work line 24 into the cylinder chamber 28. Accordingly the pressure medium is displaced from the annular chamber 30 and flows via the work line 26, the work port B, and the cut-off block 38 opened by the constant control pressure $p_x$, the drain passage 54, the opened drain measuring orifice 42, the return passage 50, via the return port R and the return line 22 back to the tank. The pressures in the supply passage 52 and in the drain passage 54 are compared through the intermediary of the inverse shuttle valve 74 as well as the shuttle valve 80. The higher one of the two pressures is conveyed via the shuttle valve 80 as a LS signal to the LS shuttle valve 82 and from there (if no other higher load pressure is present) to a control surface of the inlet pressure compensator 14 that acts in the closing direction. The lower one of the two pressures is reported via the inverse shuttle valve 74 and the reporting passage 68 to the individual pressure compensator 32 and there compared with the constant control pressure $p_x$. By means of this arrangement, the pressure medium volume flow through the supply passage 52 is adjusted by the supply measuring orifice 40 in such a way that a constant pressure is maintained upstream from the drain control edge in the drain passage 54 opening the drain measuring orifice 42. If the lower pressure tapped via the inverse shuttle valve becomes higher than the constant pressure $p_x$ (minus the force of the pressure compensator spring 66), the pressure compensator spool of the individual pressure compensator 32 throttles the pressure medium flow more strongly. If the lower pressure tapped via the inverse shuttle valve 74 is too low, the flow opening of the individual pressure compensator 32 is enlarged, and correspondingly more pressure medium is conducted to the supply measuring orifice 40.

Driven Load

In the case of a driven load, the pressure in the supply passage 52 is higher than the pressure in the drain passage 54. Apart from the pressure loss across the cut-off block 36 in the supply acting as a check valve, this higher pressure is passed on as a LS signal, and the inlet pressure compensator 14 is adjusted such that the pressure in the pump line 10 is above this highest load pressure by a predetermined pressure difference $\Delta p$. The lower pressure on the drain side is reported to the individual pressure compensator 32 and is about 0 bar while the directional control valve 34 is not actuated. The individual pressure compensator 32 is then opened completely by the constant control pressure $p_x$. When the directional control valve 34 is actuated, pressure medium is conveyed by the pump 8 into the cylinder chamber 28 of the cylinder 2 until the pressure on the drain side, i.e., in the drain passage 54, reaches the value of the constant pressure $p_x$ (minus the force of the pressure compensator spring 66). The pressure compensator spool of the individual pressure compensator 32 reduces the opening cross-section of the individual pressure compensator so that the pressure upstream from the drain measuring orifice 42 is maintained constant.

Upon opening the drain measuring orifice 42, the pressure in the drain passage 54 initially drops so that the individual pressure compensator 32 opens to some degree and the pressure medium volume flow across the supply measuring orifice 40 increases until the pressure in the drain passage 54 again reaches the regulating pressure of the individual pressure compensator. The pressure medium volume flow on the supply side is accordingly regulated such that the pressure upstream from the drain measuring orifice 42 remains constant at the regulating pressure of the individual pressure compensator 32. Thus the opening cross-section of the drain measuring orifice 42 jointly with the regulating pressure of the individual pressure compensator 32 determines the pressure medium volume flow. The cylinder 2 is then clamped, with this clamping force being adaptable by suitably selecting the control pressure $p_x$.

Pulling Load

In the case of a pulling load, the pressure in the drain passage 54 is higher than the pressure in the supply passage 52. This pressure in the drain passage 54 is maintained constant by the load-compensated cut-off block 38, with this value being comparatively low. This regulating pressure of the cut-off block 38 is output as a LS signal via the shuttle valves 80, 82 to the pressure medium supply 6: the pressure in the pump line 10 is adjusted to a comparatively low stand-by pressure.

On the supply side, i.e., in the supply passage 52, only a very low pressure or no pressure at all is present in the case of a pulling load. This lower pressure is reported via the inverse shuttle valve 74 to the individual pressure compensator 32. The latter is fully opened while the directional control valve 34 is not actuated. When the directional control valve 34 is actuated and the supply measuring orifice 40 is opened, the pump pressure is sufficient for raising the pressure in the supply passage 52 to such an extent that the individual pressure compensator 32 is moved into a regulating position. When the pressure in the supply reaches the regulating pressure of the individual pressure compensator 32, the latter is closed. In this way the supply-side pressure may be maintained at a constant value that corresponds to the regulating pressure of the individual pressure compensator 32.

Upon opening the drain control edge, i.e., upon opening the drain measuring orifice 42, the pressure in the drain passage 54 is throttled by the load-compensated cut-off block 38 from the load pressure in the annular chamber 30 or in the work line 26 to a constant level in the drain passage 54 and maintained constant. Thus the moving velocity of the cylinder is even in the case of a pulling load determined by the opening cross-section of the drain measuring orifice 42 jointly with the regulating pressure of the load-compensated cut-off block 38.

If the cylinder 2 is displaced more rapidly, the pressure in the supply passage 52 initially drops in the case of a pulling load, and correspondingly the pressure acting on the individual pressure compensator 32 in the closing direction is reduced so that the latter increases its opening cross-section until the pressure in the supply (supply passage 52) again reaches the regulating pressure of the individual pressure compensator 32. The cylinder 2 thus remains clamped with this regulating pressure even in the case of a pulling load.

By turning off the constant control pressure $p_x$ acting on the two cut-off blocks 36, 38 and the individual pressure compensator 32 in the opening direction it is possible to realize a safety function, for the two cut-off blocks 36, 38 act as check valves, and the individual pressure compensator 32 is closed. This safety function may be realized, e.g., through a separate switching valve whereby the constant control pressure $p_x$ may be turned off. This safety function may also be enabled by suitably designing the control edge of the directional control valve 34.

If the constant control pressure is merely turned off for the individual pressure compensator 32, it is possible to move the cylinder 2 without pressure medium being conveyed into the supply chamber.

The constant control pressure $p_x$ may be varied in order to adapt the pressure drop across the control edges of the directional control valve 34, and thus the pressure medium volume flow at a given measuring orifice opening, to different operating conditions.

Instead of the constant control pressure $p_x$ and the pressure compensator spring 66 it is also possible to mount on the left side (view in accordance with the single FIGURE) a spring whereby a substantially constant force is applied to the pressure compensator piston of the individual pressure compensator 32. It is also possible to employ other means for maintaining this force constant.

What is disclosed is a hydraulic control arrangement for controlling a hydraulic consumer, comprising an adjustable supply measuring orifice and an adjustable drain measuring orifice as well as a pressure compensator arranged in a pressure medium delivery. The control arrangement moreover comprises a releasable cut-off block that acts as a check valve in the direction of supply and may be released in the direction of drain by means of a control pressure. In accordance with the invention, the pressure compensator is subjected to a constant force in the opening direction and to the lower one of the pressures downstream from the supply measuring orifice and upstream from the drain measuring orifice in the closing direction.

List of Reference Numbers

2 cylinder
4 valve arrangement
6 pressure medium supply
8 fixed displacement pump
10 pump line
12 bypass line
14 inlet pressure compensator
16 spring
18 load reporting line
20 return line
22 return line
24 work line
26 work line
28 cylinder chamber
30 annular chamber
32 individual pressure compensator
34 directional control valve
36 cut-off block
38 cut-off block
40 supply measuring orifice
42 drain measuring orifice
44 supply measuring orifice
46 drain measuring orifice
48 return passage
50 return passage
52 supply passage
54 drain passage
56 topping piston
58 topping piston
60 passage
62 passage
64 delivery passage
66 pressure compensator spring
68 reporting passage
70 tapping passage
72 tapping passage
74 inverse shuttle valve
76 branch passage
78 branch passage
80 shuttle valve
82 LS shuttle valve

The invention claimed is:

1. A hydraulic control arrangement for controlling a hydraulic consumer, comprising an adjustable supply measuring orifice and an adjustable drain measuring orifice, a pressure compensator arranged in a pressure medium delivery for controlling the pressure medium volume flow across the supply measuring orifice and comprising at least one releasable cut-off block that acts as a check valve in direction of supply and is releasable by means of a control pressure ($p_x$) in the direction of drain, characterized in that the pressure compensator is subjected to a constant force ($p_x$) in the opening direction and to the lower one of the pressures downstream from the supply measuring orifice and upstream from the drain measuring orifice.

2. The control arrangement in accordance with claim 1, wherein a flow rate of a pump is adjustable in dependence on the higher one of the two pressures.

3. The control arrangement in accordance with claim 1, wherein the drain measuring orifice and supply measuring orifice are formed by a continuously adjustable directional control valve.

4. The control arrangement in accordance with claim 3, wherein the supply cross-section controlled open by a supply control edge is larger than the drain cross-section controlled open by a drain control edge.

5. The control arrangement in accordance with claim 1, wherein the constant force is applied by a control pressure ($p_x$) acting on a control surface of the pressure compensator and/or by a spring.

6. The control arrangement in accordance with claim 5, first alternative, wherein the constant pressure ($p_x$) may be varied or reduced to Zero.

7. The control arrangement in accordance with claim 1, wherein in the supply and in the drain a respective releasable cut-off block is arranged which includes a topping piston adapted to be actuated by a control pressure.

8. The control arrangement in accordance with claim 7, wherein the topping piston is subjected to the pressure in the drain in the direction opposite to the control pressure.

9. The control arrangement in accordance with claim 7, wherein the control pressure corresponds to the constant control pressure ($p_x$).

10. The control arrangement in accordance with claim 1, wherein the lower pressure is tapped via an inverse shuttle valve.

* * * * *